US011072972B2

(12) United States Patent
Huck

(10) Patent No.: US 11,072,972 B2
(45) Date of Patent: Jul. 27, 2021

(54) RAILCAR END DOOR SUPPORT

(71) Applicant: Trinity Rail Group, LLC, Dallas, TX (US)

(72) Inventor: Kenneth W. Huck, Fairview, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 232 days.

(21) Appl. No.: 16/405,068

(22) Filed: May 7, 2019

(65) Prior Publication Data

US 2019/0360261 A1 Nov. 28, 2019

Related U.S. Application Data

(60) Provisional application No. 62/676,110, filed on May 24, 2018.

(51) Int. Cl.

| | |
|---|---|
| ***E06B 7/28*** | (2006.01) |
| ***B61D 19/00*** | (2006.01) |
| ***E05F 7/06*** | (2006.01) |
| *B61D 3/18* | (2006.01) |

(52) U.S. Cl.

CPC ..... *E06B 7/28* (2013.01); *B61D 19/001* (2013.01); *B61D 19/004* (2013.01); *E05F 7/06* (2013.01); *B61D 3/18* (2013.01); *Y10T 16/212* (2015.01); *Y10T 16/3834* (2015.01)

(58) Field of Classification Search

CPC ..... B61D 19/004; B61D 19/001; B61D 3/18; E05F 7/06; Y10T 16/3834; Y10T 16/212

USPC ..... 52/782.11; 248/201, 205.1, 213.1, 248/222.11, 222.14, 231.9; 49/396; 16/44

See application file for complete search history.

(56) References Cited

U.S. PATENT DOCUMENTS

| | | | | | |
|---|---|---|---|---|---|
| 288,028 | A | * | 11/1883 | Coultaus | E05C 19/04 292/75 |
| 995,831 | A | * | 6/1911 | Winter | E05C 19/04 292/75 |
| 1,875,965 | A | * | 9/1932 | Waters | E05C 17/446 292/73 |
| 1,944,185 | A | * | 1/1934 | Langer | B60B 33/045 16/44 |
| 2,062,320 | A | * | 12/1936 | Langer | E05C 17/44 16/44 |
| 2,176,551 | A | * | 10/1939 | Solem | B60B 33/045 16/44 |
| 2,469,464 | A | * | 5/1949 | Gratkowski | E05D 13/123 49/417 |

(Continued)

*Primary Examiner* — Brent W Herring

(74) *Attorney, Agent, or Firm* — Baker Botts, LLP

(57) ABSTRACT

An apparatus includes a transfer ball, a rod, a first bracket, a second bracket, a lock nut, an elastic element, and a threaded collar. The rod is coupled to the transfer ball and extends vertically from the transfer ball. The second bracket is positioned above the first bracket. The rod extends vertically through the first bracket and the second bracket. The lock nut engages to the rod and is positioned above the first bracket and below the second bracket. The elastic element is positioned above the lock nut and below the second bracket. The rod extends vertically through the elastic element. The threaded collar is positioned above the elastic element and below the second bracket. The threaded collar is engaged to the rod. The rod extends through the threaded collar.

15 Claims, 7 Drawing Sheets

(56) References Cited

U.S. PATENT DOCUMENTS

| | | | | | |
|---|---|---|---|---|---|
| 2,537,296 | A * | 1/1951 | Yeakel | E06B 7/20 | 49/306 |
| 2,627,081 | A * | 2/1953 | Slopa | F25D 23/00 | 16/44 |
| 2,915,776 | A * | 12/1959 | Hanson | B60B 33/045 | 16/44 |
| 3,281,992 | A * | 11/1966 | Morrison | E05F 7/06 | 49/396 |
| 4,166,516 | A * | 9/1979 | Thurmond, Jr. | E04G 5/02 | 16/19 |
| 4,320,598 | A * | 3/1982 | Rodak | E06B 7/18 | 49/480.1 |
| 5,366,231 | A * | 11/1994 | Hung | A47C 7/006 | 16/44 |
| 7,021,005 | B1 * | 4/2006 | Curry | E05F 15/624 | 49/358 |
| 7,159,278 | B2 * | 1/2007 | Hilger | E05F 7/06 | 16/102 |
| 7,930,801 | B2 * | 4/2011 | Hilger | E05F 7/06 | 16/32 |
| 2006/0185121 | A1 * | 8/2006 | Hilger | E05F 7/06 | 16/102 |
| 2007/0107161 | A1 * | 5/2007 | Hilger | E05F 7/06 | 16/102 |

* cited by examiner

RAILCAR END DOOR SUPPORT

RELATED APPLICATION

This application claims the benefit of U.S. Provisional Application Ser. No. 62/676,110 filed May 24, 2018, and entitled "Railcar End Door," having common inventorship, the entire contents of which are incorporated herein by reference.

TECHNICAL FIELD

This disclosure relates generally to configuring railroad freight cars (also referred to as "railcars").

BACKGROUND

Railcars are configured to store and transport freight across long distances. Some types of railcars have end doors that close to secure the contents of the railcars.

SUMMARY

Railcars are configured to store and transport freight across long distances. For example, an autorack car is configured with one or more decks that carry automobiles. The railcars typically include doors at the ends of the railcars that protect the freight as the railcar is traveling. The doors can be opened to access the freight and closed during transport.

It is typically desirable for there to be some mechanism to support the weight of the end doors but allow easy lateral movement. In one example, railcar end enclosures (doors) may rotate or move laterally from their closed to their open position to allow access into the interior of the railcar. These end doors can weigh several hundred pounds, but their movement force should be low enough for a person to control its movement. In some cases, the end doors may be fully supported by rollers under the end doors, but if the floor of the railcar is uneven, the rollers may not contact the floor and thus fail to support the weight of the doors. In other cases, the end doors may be attached to the railcar structure with hinges, but when the weight of the end doors is fully supported by the hinges, the weight may impart significant loads onto the hinges during normal operation of the railcar due to vibrations and impact loads. These loads may be excessive and can lead to premature hinge failure or require the hinges to be oversized to account for the loads.

This disclosure contemplates a rolling support that provides vertical support to reduce loads on other components, such as end doors. The rolling support allows for adjustment of height independent of the adjustment for how much support is desired. The rolling support generally includes a transfer ball that rolls along the floor of the railcar. The transfer ball is coupled to a rod that extends vertically upwards from the transfer ball. The rod couples to a door of the railcar. Various components engaged with the rod allow adjustment of the height of the rolling support and how much support is provided by the rolling support. Three embodiments are described below.

According to an embodiment, an apparatus includes a transfer ball, a rod, a first bracket, a second bracket, a lock nut, an elastic element, and a threaded collar. The rod is coupled to the transfer ball and extends vertically from the transfer ball. The second bracket is positioned above the first bracket. The rod extends vertically through the first bracket and the second bracket. The lock nut engages to the rod and is positioned above the first bracket and below the second bracket. The elastic element is positioned above the lock nut and below the second bracket. The rod extends vertically through the elastic element. The threaded collar is positioned above the elastic element and below the second bracket. The threaded collar is engaged to the rod. The rod extends through the threaded collar.

According to another embodiment, a railcar includes a floor, an end door, and a rolling support. The end door is positioned at an end of the floor. The rolling support is coupled to the end door and supports the end door on the floor. The rolling support includes a transfer ball, a rod, a first bracket, a second bracket, a lock nut, an elastic element, and a threaded collar. The transfer ball rolls on the floor. The rod is coupled to the transfer ball and extends vertically from the transfer ball. The first bracket is coupled to the end door. The second bracket is positioned above the first bracket and is coupled to the end door. The rod extends vertically through the first bracket and the second bracket. The lock nut is engaged to the rod and is positioned above the first bracket and below the second bracket. The elastic element is positioned above the lock nut and below the second bracket. The rod extends vertically through the elastic element. The threaded collar is positioned above the elastic element and below the second bracket. The threaded collar is engaged to the rod. The rod extends through the threaded collar.

According to yet another embodiment, a method includes turning a lock nut of a rolling support to adjust a vertical distance between a transfer ball and a first bracket. The transfer ball is coupled to a rod that extends vertically from the transfer ball. The method also includes turning a threaded collar engaged to the rod to adjust a vertical force applied downward on an elastic element. The elastic element is positioned above the lock nut and below the threaded collar. The threaded collar, elastic element, and lock nut are positioned between the first bracket and the second bracket. The rod extends through the first bracket and the second bracket. The lock nut and the threaded collar are engaged to the rod.

Certain embodiments may provide one or more technical advantages. For example, an embodiment allows an end door to be supported while open or closed. As another example, an embodiment allows an end door of a railcar to be supported by a floor of the railcar even if the railcar floor is uneven. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1A:
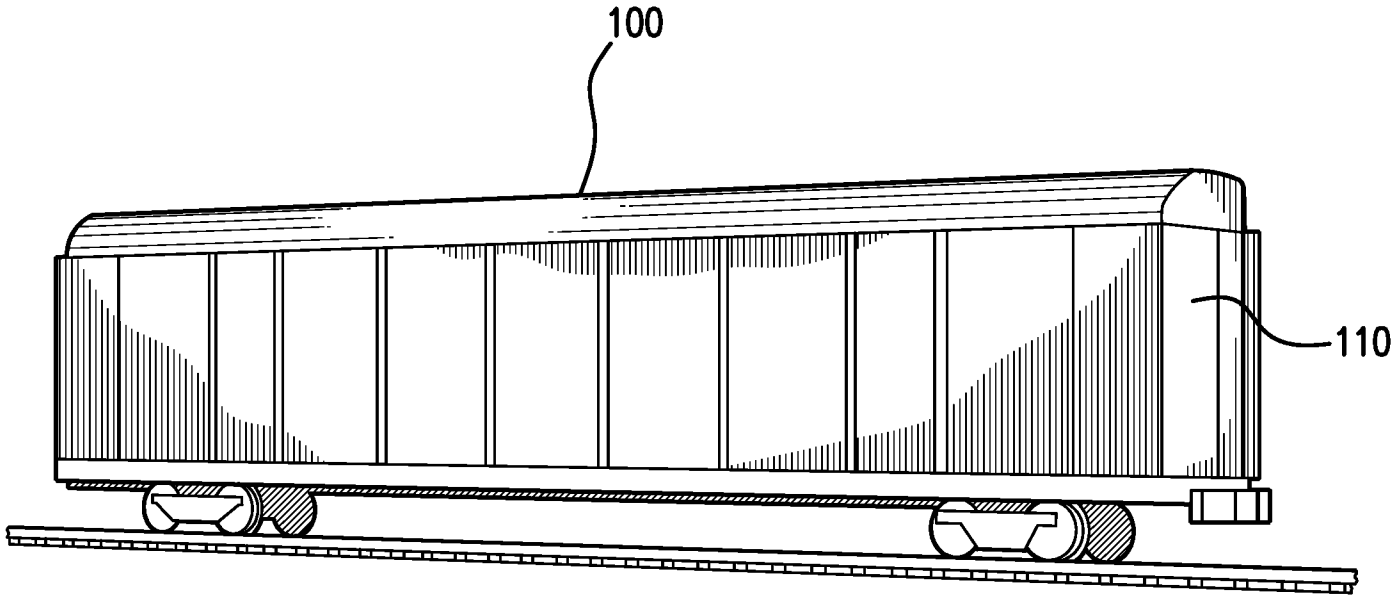
FIG. 1A illustrates an example railcar.

Embodiments of the present disclosure and its advantages are best understood by referring to the drawings, like numerals being used for like and corresponding parts of the various drawings.

Railcars are configured to store and transport freight across long distances. For example, an autorack car is configured with one or more decks that carry or support the weight of one or more automobiles. The railcars typically include doors at the ends of the railcars that protect the freight as the railcar is traveling. The doors can be opened to access the freight and closed during transport.

FIG. 1A illustrates an example railcar 100. As shown in FIG. 1A, railcar 100 includes an end door 110. End door 110 can close to protect the freight within railcar 100 during transport.

Figure 1B:
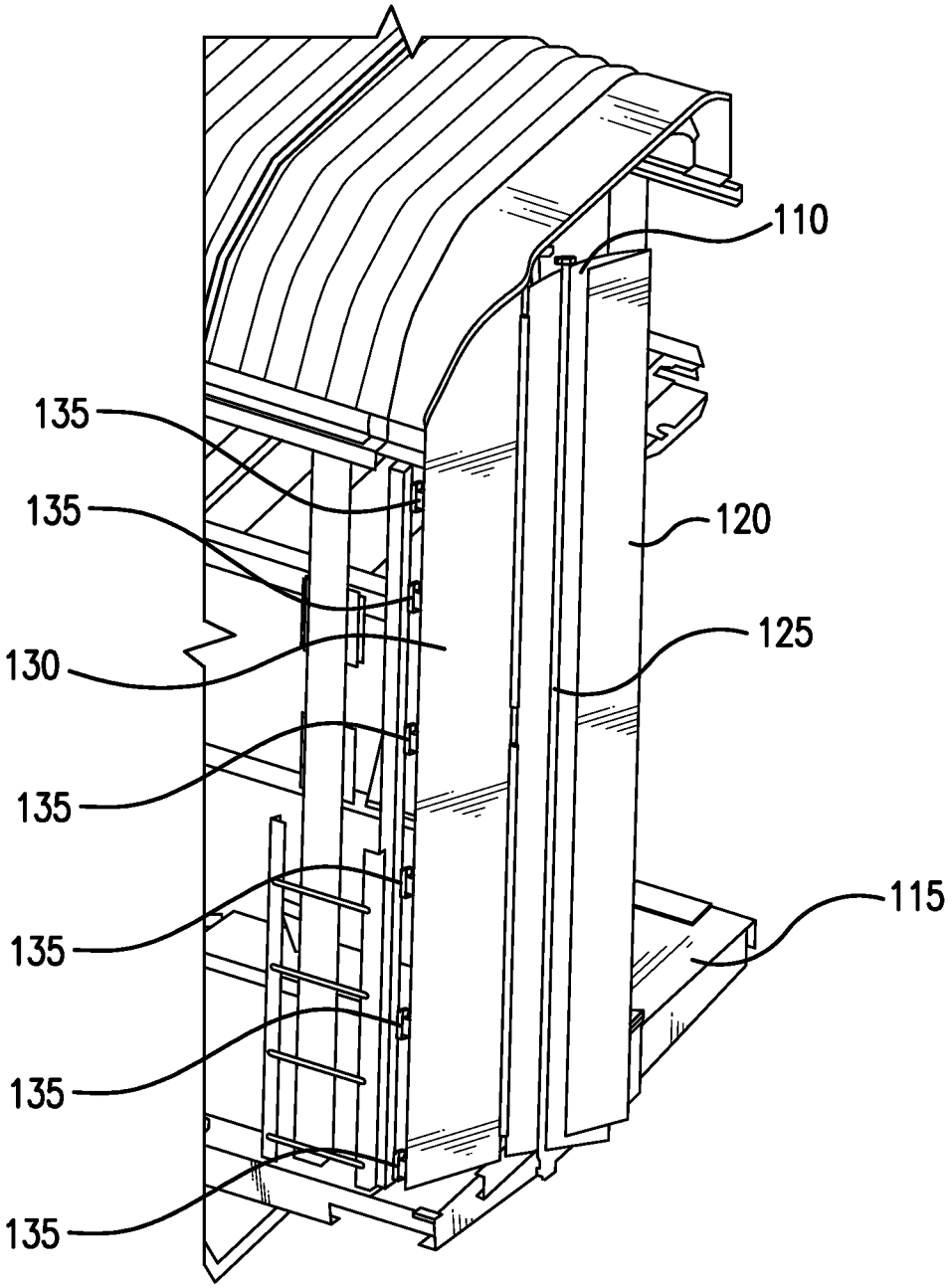
FIG. 1B illustrates an example end door of the railcar of FIG. 1A.

FIG. 1B illustrates an example end door 110 of the railcar 100 of FIG. 1A. As shown in FIG. 1B, end door 110 is coupled to railcar 100 using one or more hinges 135. End door 110 is positioned above floor 115 of railcar 100. End door 110 opens and closes by swinging or rotating on hinges 135. This disclosure contemplates railcar 100 including any number of hinges to couple railcar 100 to end door 110. In existing railcars, end door 110 can weigh several hundred pounds and its weight should be supported. In some railcars, a support is added to the bottom of end door 110 so that the support can support the weight of end door 110 on the floor 115 of railcar 100. However, this support may fail to contact floor 115 if floor 115 is uneven or if door 110 is opened all the way such that the support is positioned beyond the side of railcar 100. In some railcars, additional hinges or sturdier hinges are used to support the weight of end door 110. However, during transport, vibrations and impact loads increase the strain on these hinges and may result in premature hinge failure or deformation.

In certain embodiments, end door 110 is a folding door and includes one or more panels. In the example of FIG. 1B, end door 110 includes three panels 120, 125, and 130. Panel 120 is coupled to panel 125. Panel 125 is coupled to panel 120 and panel 130. Panel 120 rotates or folds towards and away from panel 125 to extend or retract the length of end door 110. Likewise, panel 125 rotates or folds towards and away from panel 130 to extend or retract the length of end door 110. Panel 130 is coupled to railcar 100 by the one or more hinges 135. Panel 130 rotates or swings about hinges 135 to open and close end door 110.

Although the example illustrated in FIG. 1B presents a railcar 100 in which end door 110 is a folding door, this disclosure may be applied to a variety of other types of doors, such as radial doors, or any other types of structures or objects that require support that is adjustable for both height and force.

Figure 1C:
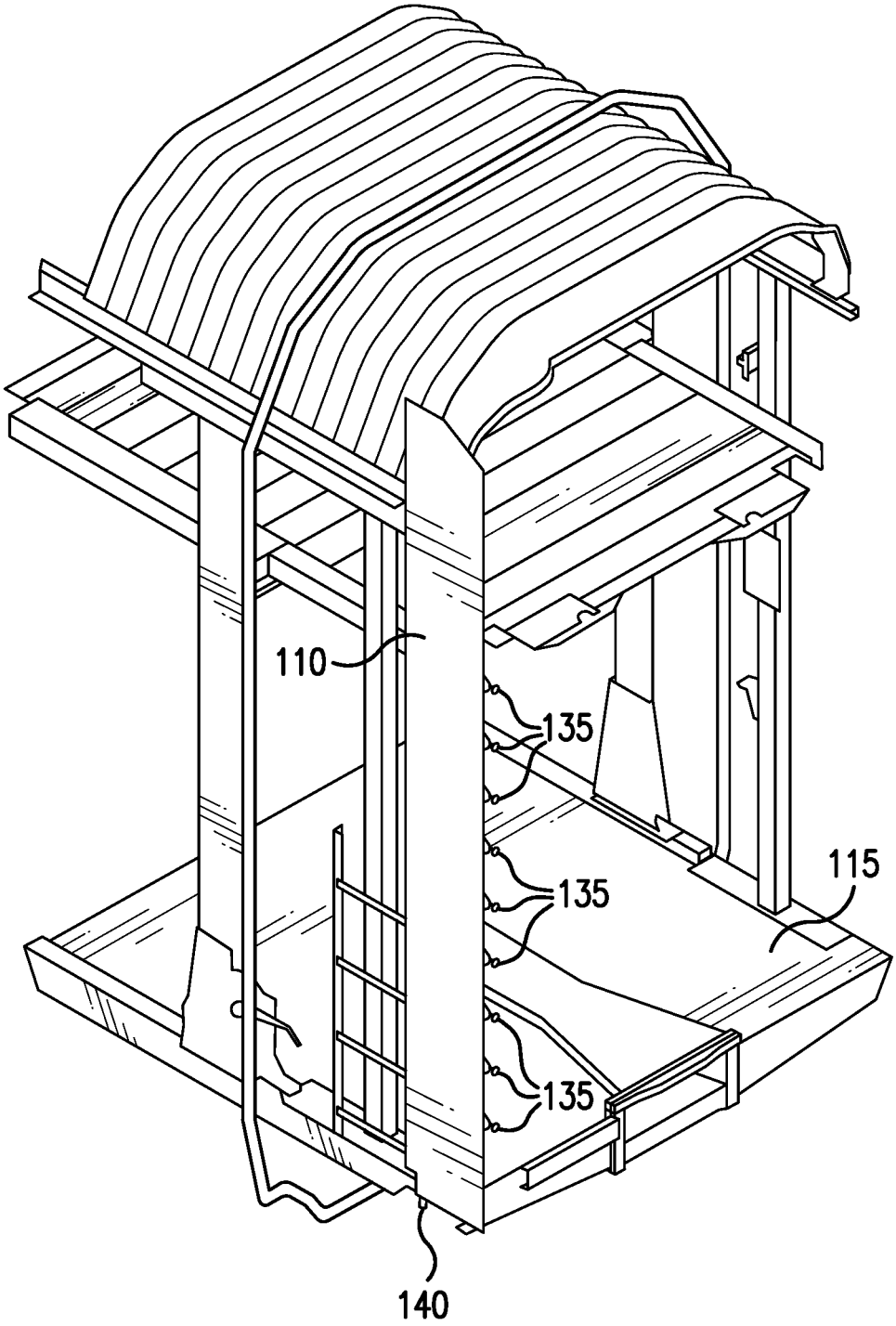
FIG. 1C illustrates an example end door of the railcar of FIG. 1A.

FIG. 1C illustrates an example end door 110 of the railcar 100 of FIG. 1A, in which the various panels of end door 100 have been folded together and end door 110 is rotated open on hinges 135. As seen in FIG. 1C, the end door 110 of railcar 100 is completely open. Additionally, end door 110 hangs off the side of floor 115 such that a support 140 at the bottom of door 110 does not support the weight of end door 110 on floor 115. As a result, all of the weight of end door 110 is supported by the hinges 135, which could result in premature hinge failure.

This disclosure contemplates an end door assembly that includes a rolling support that provides vertical support to reduce loads on other components, such as end doors and hinges. The rolling support allows for adjustment of height independent of the adjustment for how much support is desired. The rolling support generally includes a transfer ball that rolls along the floor of the railcar. The transfer ball is coupled to a rod that extends vertically upwards from the transfer ball. The rod couples to a door of the railcar. Various components engaged with the rod allow adjustment of the height of the rolling support and how much support is provided by the rolling support. The end door assembly will be described in more detail using FIGS. 2A, 2B, 3, and 4.

Although this embodiment describes a transfer ball, other types of rolling or sliding elements may be applied to the end of the adjustable rod.

Figure 2A:
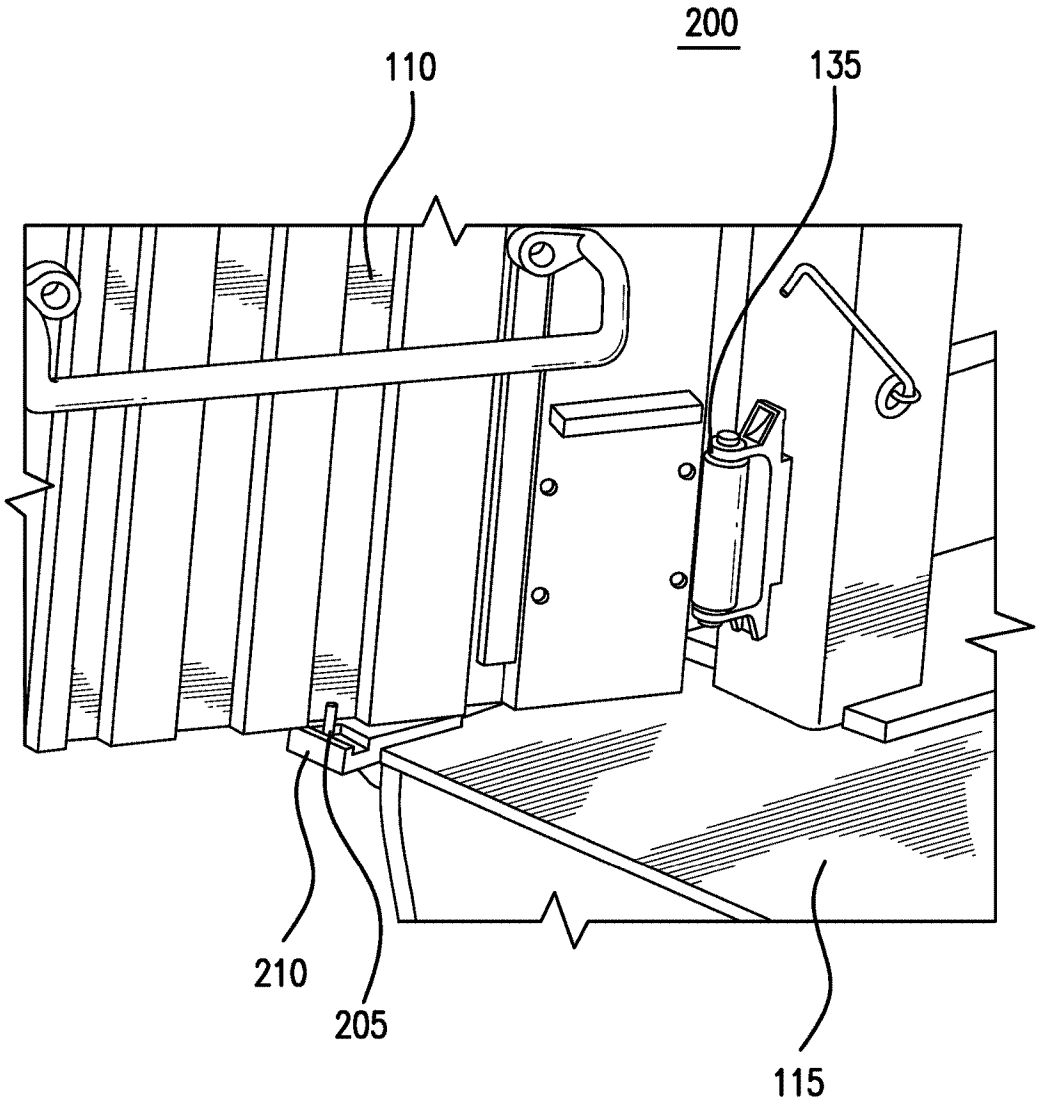
FIG. 2A illustrates an example end door assembly.

FIG. 2A illustrates an example end door assembly 200. As seen in FIG. 2A, the end door assembly 200 includes an end door 110 coupled to railcar 100 by one or more hinges 135. A rolling support 205 is coupled to end door 110 near a bottom edge of end door 110. A platform 210 is coupled to a side of floor 115 and extends beyond the edge of floor 115. Rolling support 205 is configured to rest on platform 210 such that rolling support 205 supports the weight of end door 110 on platform 210 when end door 110 is open and extends beyond the side of floor 115. Additionally, rolling support 205 is configured to rest on floor 115 when end door 110 is closed, such that rolling support 205 supports the weight of end door 110 on floor 115 when end door 110 is closed and when end door 110 is open but does not extend beyond the side of floor 115. In this manner, hinges 135 do not support all the weight of end door 110.

Figure 2B:
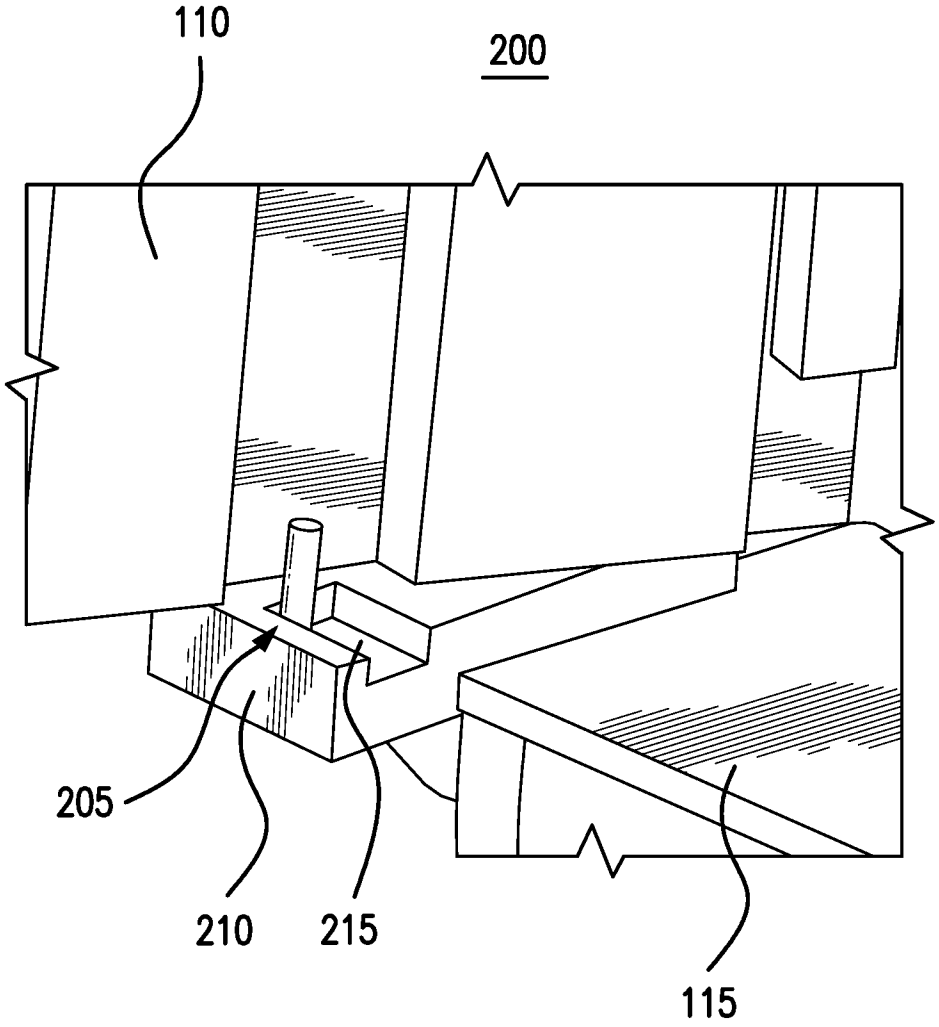
FIG. 2B illustrates the example end door assembly of FIG. 2A.

FIG. 2B illustrates a view of the end door assembly 200 of FIG. 2A. As seen in FIG. 2B, end door assembly 200 includes end door 110, rolling support 205, and platform 210. Rolling support 205 is coupled to end door 110 near a bottom edge of end door 110. Rolling support 205 supports the weight of end door 110 on platform 210 when end door 110 is open and extends beyond a side of floor 115. When end door 110 is closed, or when end door 110 is open but does not extend beyond a side of floor 115, rolling support 205 supports the weight of end door 110 on floor 115.

Platform 210 is coupled to a side of floor 115 and extends beyond the side of floor 115. Platform 210 includes a groove 215 cut into platform 210. Groove 215 allows for rolling support 205 to contact platform 210 and support the weight of end door 110 on platform 210. Groove 215 also sets the boundaries for rolling support 205 so that rolling support 205 does not travel beyond the walls of groove 215. The extent of groove 215 in the direction away from the side of floor 115 determines the angular amount by which end door 110 can rotate open on hinges 135.

In certain embodiments, groove 215 is curved to accommodate the movement of rolling support 205 along an arc on which rolling support 205 travels as end door 110 rotates open on hinges 135. In certain other embodiments, groove 215 is rectangular in shape, with a width measured along the direction parallel to the side of floor 115 that is large enough to accommodate the movement of rolling support 205 along the arc on which rolling support 205 travels as end door 110 rotates open on hinges 135.

In certain embodiments, platform 210 rises above floor 115 and groove 215 is level with floor 115. In this manner, there is little to no vertical displacement when rolling support 205 moves between floor 115 and platform 210 when end door 110 opens and closes. In certain embodiments, platform 210 allows for rolling support 205 to support the weight of end door 110 even though end door 110 extends beyond the side of floor 115 when open.

Figure 2C:
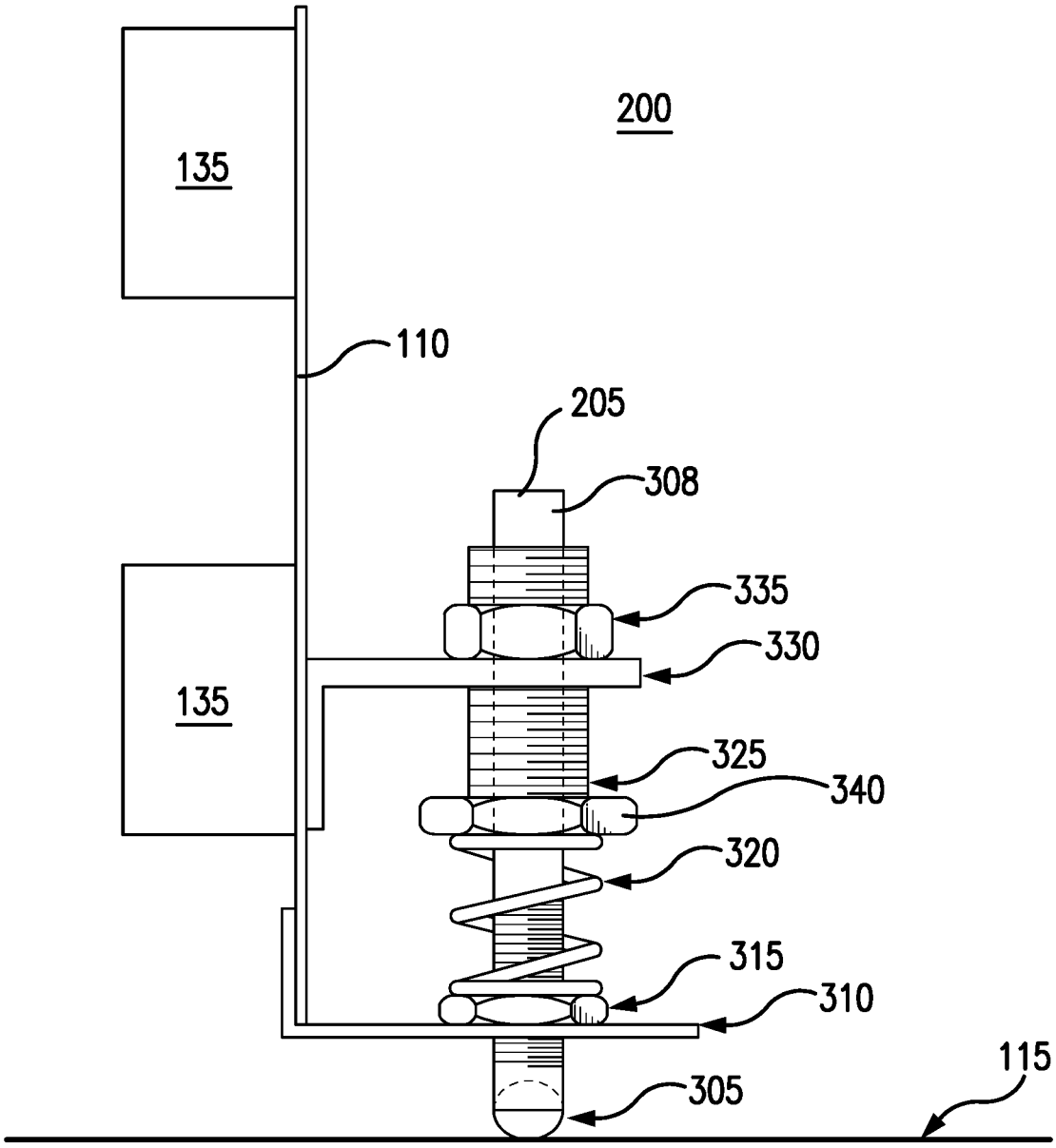
FIG. 2C illustrates the example end door assembly of FIG. 2A.

FIG. 2C illustrates the example end door assembly 200 of FIG. 2A. As seen in FIG. 2C, end door assembly 200 includes an end door 110 coupled to hinges 135. Rolling support 205 is coupled to end door 110 using brackets 310 and 330. Rolling support 205 supports the weight of end door 110 on floor 115 and/or platform 210. In certain embodiments, rolling support 205 allows for the independent adjustment of height and the amount of support provided by rolling support 205. By adding vertical support to end door 110 while also allowing lateral movement, loads in other support components may be reduced. Adjustment is provided for height as well as the amount of support desired.

Rolling support 205 includes a transfer ball 305 at the bottom of rolling support 205. In certain embodiments, transfer ball 305 is a ball bearing. Transfer ball 305 is designed to contact and roll along floor 115 and/or platform 210. As a result, transfer ball 305 supports the weight of end door 110 and allows end door 110 to open and close. A vertical rod 308 is coupled to transfer ball 305. Rod 308 extends vertically upwards from transfer ball 305 and extends through brackets 310 and 330. Rod 308 may be allowed to slide laterally along brackets 310 and 330 towards and away from end door 110. Rod 308 may also slide vertically through brackets 310 and 330.

Brackets 310 and 330 are angled brackets that couple to end door 110. Bracket 310 is positioned beneath bracket 330. This disclosure contemplates brackets 310 and 330 being coupled to end door 110 in any suitable manner. For example, brackets 310 and 330 may be bolted, screwed, glued, or welded onto end door 110. Brackets 310 and 330 transfer the weight of end door 110 down into transfer ball 305. Bracket 330 is coupled to the side of end door 110 that faces the inside of railcar 100, when end door 110 is closed, and extends towards the inside of railcar 100, when end door 110 is closed. In certain embodiments, bracket 310 is similarly coupled to the side of end door 110 that faces the inside of railcar 100, when end door 110 is closed, and extends towards the inside of railcar 100, when end door 110 is closed. In other embodiments, bracket 310 is coupled to the side of end door 110 that faces outside when end door 110 is closed and extends towards the inside of railcar 100, when end door 110 is closed.

A lock nut 315 is engaged to rod 308 by a threaded connection. Lock nut 315 is positioned above bracket 310 and below bracket 330. In certain embodiments, lock nut 315 directly contacts bracket 310 and is allowed to slide with respect to bracket 330. By turning nut 315, the distance between transfer ball 305 and bracket 310 is adjusted. As a result, rolling support 205 can be adjusted to accommodate any suitable height of end door 110. In other words, rolling support 205 can be adjusted to accommodate any suitable distance between end door 110 and floor 115. Thus, even if floor 115 is uneven, the vertical position of rolling support 205 can be set so that rolling support 205 contacts even the uneven surfaces of floor 115. In certain embodiments, the length that the transfer ball 305 extends past bracket 310 is adjusted by turning rod 308 with respect to lock nut 315 or by turning lock nut 315 with respect to rod 308. Adjustment may account for tolerance between the hinge 135 locations and the floor 115 to maintain contact between the transfer ball 305 and the floor 115.

An elastic element 320 is positioned above lock nut 315 and between brackets 310 and 330. Rod 308 extends through elastic element 320. This disclosure contemplates elastic element being any suitable elastic element such as a spring or an elastomer. Elastic element 320 provides support for the weight of end door 110. The compression of elastic element 320 can be adjusted to allow for elastic element 320 to support more or less of the weight of end door 110. For example, elastic element 320 can be compressed more so that it supports more of the weight of end door 110. As another example, elastic element 320 can be less compressed so that it supports less of the weight of end door 110.

A threaded collar 325 is positioned above elastic element 320 and between brackets 310 and 330. Rod 308 extends through threaded collar 325. Threaded collar 325 may engage bracket 330 through a threaded connection. In certain embodiments, threaded collar 325 directly contacts bracket 330. Threaded collar 325 provides a downward force onto elastic element 320. By turning threaded collar 325, more or less downward force is applied to elastic element 320. As a result, the compression of elastic element 320 can be adjusted so that elastic element 320 supports more or less of the weight of end door 110. In certain embodiments, an additional lock nut 340 is engaged to threaded collar 325 by a threaded connection on the exterior of threaded collar 325. In certain embodiments, the lock nut 340 may be integral with threaded collar 325 or it may be connected to threaded collar 325 via a threaded connection. The lock nut 340 directly contacts elastic element 320 and applies a downward force onto elastic element 320. Turning threaded collar 325 or the lock nut adjusts the amount of downward force applied to elastic element 320.

In certain embodiments, threaded collar 325 is attached to bracket 330 via a threaded connection. The rod 308 protrudes through the threaded collar 325, and therefore the bracket 330, via a sliding interface. By adjusting the threaded collar 325 with respect to the bracket 330, the height of the elastic element 320 is adjusted. Adjusting the height of the elastic element 320 determines the force required to be applied to the transfer ball 305 to move the transfer ball 305 and rod 308 vertically. This determines the amount of vertical support permitted by the transfer ball 305 and the reduction in support required by the hinges 135.

In particular embodiments, the vertical position of rolling support 205 is adjusted independent of the support provided by rolling support 205. For example, turning lock nut 315 adjusts the vertical position of rolling support 205 while turning threaded collar 325 adjusts the support provided by rolling support 205.

Lock nut 335 is positioned above bracket 330. Threaded collar 325 extends through lock nut 335 and rod 308 extends through threaded collar 325. Lock nut 335 directly contacts bracket 330 and in some embodiments, prevents rolling support 205 from moving downwards past a particular point set by lock 335. In certain embodiments, the top of the threaded collar 325 is attached to lock nut 335 to prevent the threaded collar 325 from inadvertently rotating and changing the force applied to elastic element 320. In certain such embodiments, lock nut 335 is attached to threaded collar 325 through a threaded connection.

From bottom to top the relative positions of the various components of rolling support 205 along vertical rod 308, in certain embodiments, are as follows. Transfer ball 305 is coupled to the bottom of vertical rod 308. Next, rod 308 extends through bracket 310. Above bracket 310, lock nut 315 is engaged to rod 308 by a threaded connection. Rod 308 then passes through elastic element 320, which is positioned above lock nut 315. Next, rod 308 passes through threaded collar 325, where an additional lock nut 340 is engaged to a lower portion of threaded collar 325 by a threaded connection on the exterior of threaded collar 325. Rod 308 and threaded collar 325 then extend through bracket 330, with threaded collar 325 engaged to bracket 330 through a threaded connection. Finally, lock nut 335 is positioned above bracket 330, and is attached to threaded collar 325.

Figure 3:
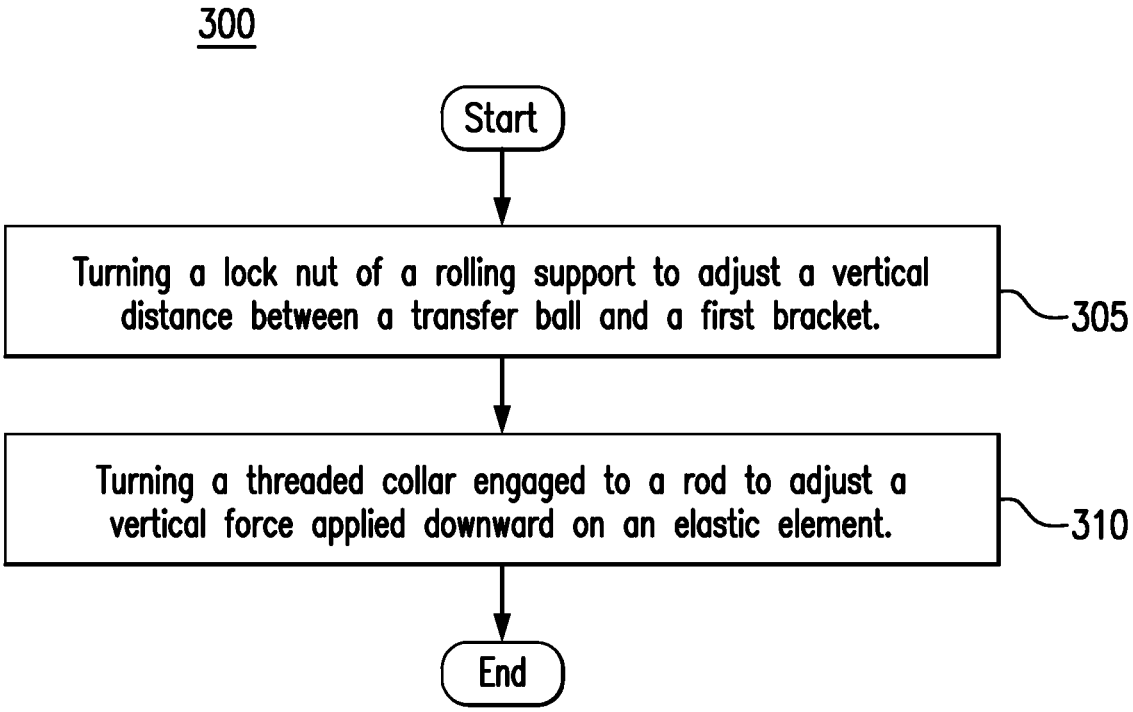
FIG. 3 is a flowchart illustrating a method of adjusting an end door assembly.

FIG. 3 is a flowchart illustrating a method 300 of adjusting an end door assembly. In particular embodiments, an operator performs method 300. By performing method 300, the operator can adjust a vertical position of a rolling support independent of the support provided by the rolling support. The operator begins in step 305 by turning a lock nut 315 of a rolling support to adjust a vertical distance between a transfer ball and a first bracket in step 305. This adjustment allows the rolling support to contact uneven surfaces of a floor of a railcar and to accommodate any distance between the end door and the floor of the railcar. In step 310, the operator turns a threaded collar 325 engaged to a rod 308 to adjust a vertical force applied downward on an elastic element 320. This adjustment allows the rolling support to accommodate different weights of end doors 110 and different types of floors 115. Then lock nut 335 is tightened to maintain the position of threaded collar 325.

Modifications, additions, or omissions may be made to method 300 depicted in FIG. 3. Method 300 may include more, fewer, or other steps. For example, steps may be performed in parallel or in any suitable order. While discussed as an operator performing the steps, any suitable person may perform one or more steps of the method.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. An apparatus comprising:

a transfer ball;

a rod coupled to the transfer ball, the rod extending vertically from the transfer ball;

a first bracket;

a second bracket positioned above the first bracket, the rod extending vertically through the first bracket and the second bracket;

a lock nut engaged to the rod and positioned above the first bracket and below the second bracket;

an elastic element positioned above the lock nut and below the second bracket, the rod extending vertically through the elastic element; and a threaded collar positioned above the elastic element and below the second bracket, the threaded collar engaged to the rod, the rod extending through the threaded collar.

2. The apparatus of claim 1, wherein the lock nut directly contacts the first bracket and the threaded collar directly contacts the second bracket.

3. The apparatus of claim 1, further comprising a second locknut positioned above the second bracket and directly contacting the second bracket, the second lock nut engaged to the rod.

4. The apparatus of claim 1, wherein the lock nut is configured, when turned, to adjust a vertical distance between the transfer ball and the first bracket.

5. The apparatus of claim 1, wherein the threaded collar is configured, when turned, to adjust a vertical force applied downward on the elastic element.

6. The apparatus of claim 1, wherein the elastic element is a spring.

7. The apparatus of claim 1, wherein the elastic element is an elastomer.

8. A railcar comprising:

a floor;

an end door positioned at an end of the floor; and a rolling support coupled to the end door and configured support the end door on the floor, the rolling support comprising:

a transfer ball configured to roll on the floor;

a rod coupled to the transfer ball, the rod extending vertically from the transfer ball;

a first bracket coupled to the end door;

a second bracket positioned above the first bracket and coupled to the end door, the rod extending vertically through the first bracket and the second bracket;

a lock nut engaged to the rod and positioned above the first bracket and below the second bracket;

an elastic element positioned above the lock nut and below the second bracket, the rod extending vertically through the elastic element; and a threaded collar positioned above the elastic element and below the second bracket, the threaded collar engaged to the rod, the rod extending through the threaded collar.

9. The railcar of claim 8, wherein the lock nut directly contacts the first bracket and the threaded collar directly contacts the second bracket.

10. The railcar of claim 8, further comprising a second locknut positioned above the second bracket and directly contacting the second bracket, the second lock nut engaged to the rod.

11. The railcar of claim 8, wherein the lock nut is configured, when turned, to adjust a vertical distance between the transfer ball and the first bracket.

12. The railcar of claim 8, wherein the threaded collar is configured, when turned, to adjust a vertical force applied downward on the elastic element.

13. The railcar of claim 8, wherein the elastic element is a spring.

14. The railcar of claim 8, wherein the elastic element is an elastomer.

15. The railcar of claim 8, further comprising a platform coupled to the floor and extending from a side of the floor, the platform configured to support the transfer ball when the end door is open.

* * * * *